US005433991A

United States Patent [19]

Boyd, Jr. et al.

[11] Patent Number: 5,433,991

[45] Date of Patent: Jul. 18, 1995

[54] REINFORCEMENT SYSTEM FOR MASTIC INTUMESCENT FIRE PROTECTION COATINGS COMPRISING A HYBRID MESH FABRIC

[75] Inventors: George P. Boyd, Jr., No. Alltleboro, Mass.; George K. Castle, Hollis, N.H.

[73] Assignee: Avco Corporation, Providence, R.I.

[21] Appl. No.: 320,764

[22] Filed: Oct. 7, 1994

Related U.S. Application Data

[63] Continuation of Ser. No. 23,812, Feb. 26, 1993, abandoned, which is a continuation-in-part of Ser. No. 983,877, Dec. 1, 1992.

[51] Int. Cl.[6] ..... D06P 7/00; B32B 7/00; B32B 5/06

[52] U.S. Cl. ..... 428/193; 87/1; 87/5; 87/12; 66/192; 139/420 R; 139/420 C; 428/253; 428/255; 428/257; 428/297; 428/902

[58] Field of Search ..... 428/255, 257, 258, 259, 428/278, 408, 902, 193, 253; 139/363 R, 420 R, 420 C; 87/1, 12, 5

[56] References Cited

U.S. PATENT DOCUMENTS

| | | | |
|---|---|---|---|
| 739,646 | 9/1903 | Carter . | |
| 1,014,416 | 1/1912 | Schweikert . | |
| 1,988,081 | 1/1935 | Kemper | 72/109 |
| 2,148,281 | 2/1939 | Scott | 72/16 |
| 2,213,603 | 9/1940 | Young et al. | 73/70 |
| 2,218,965 | 10/1940 | Young | 72/67 |
| 3,320,087 | 5/1987 | Erickson | 117/137 |
| 3,516,213 | 6/1970 | Sauer | 52/725 |
| 3,872,636 | 3/1975 | Nicosia | 52/364 |
| 3,913,290 | 10/1975 | Billings et al. | 52/347 |
| 3,915,777 | 10/1975 | Kaplan | 156/202 |
| 3,960,626 | 6/1976 | Casadevall | 156/93 |
| 4,069,075 | 1/1978 | Billings et al. | 156/82 |
| 4,133,928 | 1/1979 | Riley et al. | 428/255 |
| 4,160,073 | 7/1979 | Lloyd-Lucas et al. | 521/122 |
| 4,198,493 | 4/1980 | Marciandi | 525/164 |

(List continued on next page.)

FOREIGN PATENT DOCUMENTS

| | | |
|---|---|---|
| 592353 | 1/1987 | Australia . |
| 2009794 | 9/1990 | Canada . |
| 066979A | 12/1982 | European Pat. Off. . |
| 511017A | 10/1992 | European Pat. Off. . |
| 3115786 | 11/1982 | Germany . |
| 19262 | 12/1909 | United Kingdom . |
| 832805 | 4/1960 | United Kingdom . |
| 879383 | 10/1961 | United Kingdom . |
| 904796 | 8/1962 | United Kingdom . |
| 956060 | 4/1964 | United Kingdom . |
| 973692 | 10/1964 | United Kingdom . |
| 1084503 | 9/1967 | United Kingdom . |

(List continued on next page.)

OTHER PUBLICATIONS

Zola, J. C., "High Heat-and Flame-Resistant Mastics", in *Fire Retard Paints, Advances in Chemistry Series, No. 9*, Amer. Chem. Soc., Washington D.C., 1954.

"Mesh Reinforcement-A must for Monolithic Fireproofing Systems"Textron Specialty Materials, Technical Service Bulletin (1988).

"Pitt-Char TM Fire Protective Coating" Pittsburgh Paints, Technical Data Bulletin (Apr. 1984).

Underwriters Laboratories, "Fire Resistance Index" (Jan. 1976).

"Pitt-Char TM Fire Protectice Coating-The Coating that sets the New Standard for Hydrocarbon Fire Protection" Pittsburgh Paints (Apr. 1984).

(List continued on next page.)

*Primary Examiner*—James D. Withers

*Attorney, Agent, or Firm*—Edmund J. Walsh; Mary E. Porter

[57] ABSTRACT

A reinforcement system for mastic intumescent fire protection coatings. Free floating hybrid mesh embedded in the coating is used to reinforce the coating. The hybrid mesh is made from a combination of high temperature and low temperature yarns.

15 Claims, 2 Drawing Sheets

U.S. PATENT DOCUMENTS

| | | | |
|---|---|---|---|
| 4,276,332 | 6/1981 | Castle | 428/36 |
| 4,276,342 | 6/1981 | Johnson | 428/247 |
| 4,284,834 | 8/1981 | Austin et al. | 585/25 |
| 4,414,674 | 11/1983 | Woodruff et al. | 373/130 |
| 4,517,782 | 5/1985 | Shamszadeh | 52/309.7 |
| 4,529,467 | 7/1985 | Ward | 156/307.3 |
| 4,690,851 | 9/1987 | Auduc | 428/116 |
| 4,700,518 | 10/1987 | Akihama et al. | 52/309 |
| 4,729,916 | 3/1988 | Feldman | 428/182 |
| 4,735,841 | 4/1988 | Sourdet | 428/116 |
| 4,804,299 | 2/1989 | Forte et al. | 405/285 |
| 4,835,046 | 5/1989 | Auduc | 428/288 |
| 4,936,064 | 6/1990 | Gibb | 52/232 |
| 5,145,734 | 9/1992 | Ito et al. | 428/257 |

FOREIGN PATENT DOCUMENTS

| | | |
|---|---|---|
| 1358853 | 7/1974 | United Kingdom . |
| 1378752 | 12/1974 | United Kingdom . |
| 1387141 | 3/1975 | United Kingdom . |
| 1413016 | 11/1975 | United Kingdom . |
| 1439282 | 6/1976 | United Kingdom . |
| 1575708 | 9/1980 | United Kingdom . |
| 2097433 | 11/1982 | United Kingdom . |
| 2120580 | 12/1983 | United Kingdom . |
| 2191115 | 12/1987 | United Kingdom . |
| 2207633 | 2/1989 | United Kingdom . |

OTHER PUBLICATIONS

"FIREC® Total System-British Evolved Developed and Manufactured" Advanced Fireproofing Systems, Ltd. Technical Service Bulletin (Undated).

"FIREC® Total System-The World's Foremost Epoxy Composite Lightweight Fire Resisting Intumescent Coatings" Advanced Fireproofing Systems, Ltd., Tech. Data Bul. (Undated).

"FIREC® Fire-Resistant Coatings: Typical Properties, Chemical Resistance, Fire and Environmental Tests", ICI Specialty Chemicals, Technical Bulletin 150-3E (Undated).

"FIREC® Total System-The World's Foremost Epoxy Composite Lightweight Fire Resisting Intumescent Coatins" Advanced Fireproofing Systems, Ltd., Product Bulletin (Undated).

"FIREC®-The World's Foremost Weatherproofing Lightweight Epoxy Fire Resisting Intumescent Coatings" Advanced Fireproofing Systems, Ltd. Bulletin (Undated).

Ellard, James A., "Performance of Intumescent Fire Barriers" *American Chemical Society*-Division of Organic Coatings 165th Meeting, Dallas, Tex. (Apr. 8-13, 1973).

Patent Abstract List.

REINFORCEMENT SYSTEM FOR MASTIC INTUMESCENT FIRE PROTECTION COATINGS COMPRISING A HYBRID MESH FABRIC

This is a continuation of application Ser. No. 08/023,812 filed on Feb. 26, 1993, now abandoned, which is a continuation-in-part of application No. 07/983,877 filed on Dec. 1, 1992, still pending.

This invention relates generally to mastic fire protection coatings and more particularly to reinforcement systems for such coatings.

Mastic fire protection coatings are used to protect structures from fire. One widespread use is in hydrocarbon processing facilities, such as chemical plants, offshore oil and gas platforms and refineries. Such coatings are also used around hydrocarbon storage facilities such as LPG (liquified petroleum gas) tanks.

The coating is often applied to structural steel elements and acts as an insulating layer. In a fire, the coating retards the temperature rise in the steel to give extra time for the fire to be extinguished or the structure evacuated. Otherwise, the steel might rapidly heat and collapse.

Mastic coatings are made with a binder such as epoxy or vinyl. Various additives are included in the binder to give the coating the desired fire protective properties. The binder adheres to the steel.

One particularly useful class of mastic fire protective coatings is termed "intumescent". Intumescent coatings swell up when exposed to the heat of a fire and convert to a foam-like char. The foam-like char has a low thermal conductivity and insulates the substrate. Intumescent coatings are sometimes also called "ablative" or "subliming" coatings.

Though the mastic coatings adhere well to most substrates, it is known to embed mesh in the coatings. The mesh is mechanically attached to the substrate. U.S. Pat. Nos. 3,913,290 and 4,069,075 to Castle et al. describe the use of mesh. In those patents, the mesh is described as reinforcing the char once it forms in a fire. More specifically, the mesh reduces the chance that the coating will crack or "fissure". Fissures reduce the protection provided by the coating because they allow heat to more easily reach the substrate. When fissures in the material do occur, they are not as deep when mesh is used. As a result, the mastic does not need to be applied as thickly. Glass cloth has also been used to reinforce fire protective mastics. U.S. Pat. No. 3,915,777 describes such a system. Glass, however, softens at temperatures to which the coating might be exposed. Once the glass softens, it provides no benefits. Though the glass is partially insulated by the fire protective coating, we have recognized that intumescent systems also often contain boron or other materials which are glass fluxing agents. The fluxing agents lower the softening point of the glass reinforcement. As a result, the glass does not provide adequate reinforcement in some fire situations to which the material might be exposed.

Examples of two widely used types of glass fibers are E-glass and S-glass sold by Owens-Corning. E-glass loses 25% of its tensile strength when heated 343° C. S-glass, while slightly stronger, looses 20% of its tensile strength at the same temperature. When heated to temperatures of 732° C. and 849° C., E-glass and S-glass, respectively, have softened appreciably and by 877° C. and 970° C., E-glass and S-glass respectively, have softened so much that fibers made of these materials can not support their own weight. These low softening temperatures are a drawback of using glass reinforcement.

Use of mesh in conjunction with mastic coatings has been criticized because it increases the cost of applying the material. It would be desirable to obtain the benefits of mechanically attached wire mesh without as much added cost.

It has been suggested that woven carbon fibers be used instead of metal mesh, but no details of such a system have been disclosed. Copending application No. 07/983,877 to Castle et al, which is hereby incorporated by reference, gives details of a carbon mesh.

SUMMARY OF THE INVENTION

With the foregoing background in mind, it is an object to provide a fire protection coating system with relatively low manufacturing cost, low installation cost and good fire protection.

The foregoing and other objects are achieved with a mesh made of a combination of fibers. Non-melting, non-flammable, flexible fibers with a high softening point are interwoven with fibers with a relatively low softening point.

BRIEF DESCRIPTION OF THE DRAWINGS

The invention will be better understood by reference to the following more detailed description and accompanying drawings in which.

DESCRIPTION OF THE PREFERRED EMBODIMENT

Figure 1:
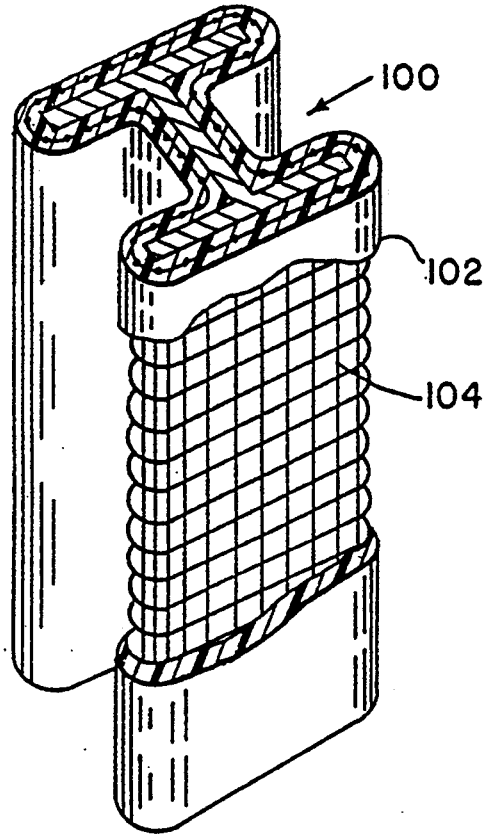
FIG. 1 shows a coating with yarn mesh embedded in it.

FIG. 1 shows a column 100 such as might be used for structural steel in a hydrocarbon processing facility. A column is illustrated. However, the invention applies to beams, joists, tubes or other types of structural members or other surfaces, such as walls, floors, decks and bulkheads, which need to be protected from fire. Coating 102 is applied to the exposed surfaces of column 100. Coating 102 is a known mastic intumescent fire protection coating. Chartek ® coating available from Textron Specialty Materials in Lowell, MAUSA is an example of one of many suitable coatings.

Coating 102 has a hybrid mesh 104 embedded in it. Hybrid mesh 104 contains a flexible, noninflammable fibrous material which maintains in excess of 80% of its room temperature tensile strength at temperatures in excess of 343° C. Preferably, the fibrous material retains in excess of 80% of its room temperature strength as temperatures above 849° C. and more preferably above 1200° C. Examples of suitable fibrous materials are carbon, boron and graphite fibers. Fibers containing carbides, such as silicon carbide or titanium carbide; borides, such as titanium diborides; oxides, such as alumina or silica; or ceramic might be used. The fibers can be used in the form of monofilaments, multifilaments, tows or yarns. If yarns are used, they may be either continuous filament yarns or discontinuous filament yarns such as stretch broken or spun yarn. Hereinafter, such materials are referred to generally as "high temperature fiber". Such high temperature fibers offer the advantage of being light and flexible in comparison to welded wire mesh. In addition, they do not burn, melt or corrode and withstand many environmental effects.

Carbon yarn is the preferred high temperature fiber. Carbon yarns are generally made from either PAN (poly acrylic nitride) fiber or pitch fiber. The PAN or pitch is then slowly heated in the presence of oxygen to a relatively low temperature, around 450° F. This slow heating process produces what is termed an "oxidized fiber". Whereas the PAN and pitch fibers are relatively flammable and lose their strength relatively quickly at elevated temperatures, the oxidized fiber is relatively nonflammable and is relatively inert at temperatures up to 300° F. At higher temperatures, the oxidized fiber may lose weight, but is acceptable for use in some fire protective coatings in some fire environments. Oxidized fiber is preferably at least 60% carbon.

Carbon fiber is made from the oxidized fiber by a second heat treating cycle according to known manufacturing techniques. This second heat treating step will not be necessary in some cases since equivalent heat treatment may occur in a fire. After heat treating, the fiber contains preferably in excess of 95% carbon, more preferably in excess of 99%. The carbon fiber is lighter, stronger and more resistant to heat or flame than the precursor materials. The carbon is, however, more expensive due to the added processing required. Carbon fiber loses only about 1% of its weight per hour at 500° C. in air. Embedded in a fire protection coating, it will degrade even less.

Hybrid mesh contains a low temperature fiber. The low temperature fiber helps hold the high temperature fiber together into a handleable mesh. We have discovered that more fibers are needed to provide a handleable mesh than are needed to provide adequate reinforcement in a fire. As a result, low temperature fibers are interwoven with high temperature fibers. The low temperature fibers are selected to be of relatively low cost and to provide good handleability to the mesh. Examples of suitable low temperature fibers are glass fibers, Kevlar fibers (trademark of DuPont for aramid), mineral fibers, basalt, organic fibers, or nylon, polyester or other synthetic fibers. Combinations of fibers mights also be used.

Glass fibers are preferred. Such fibers are relatively low cost and make a handleable material. Moreover, when hybrid mesh is used in an intumescent coating, glass fibers have a high enough softening temperature to provide some desirable effects during the early stages of intumescence.

Figure 2:
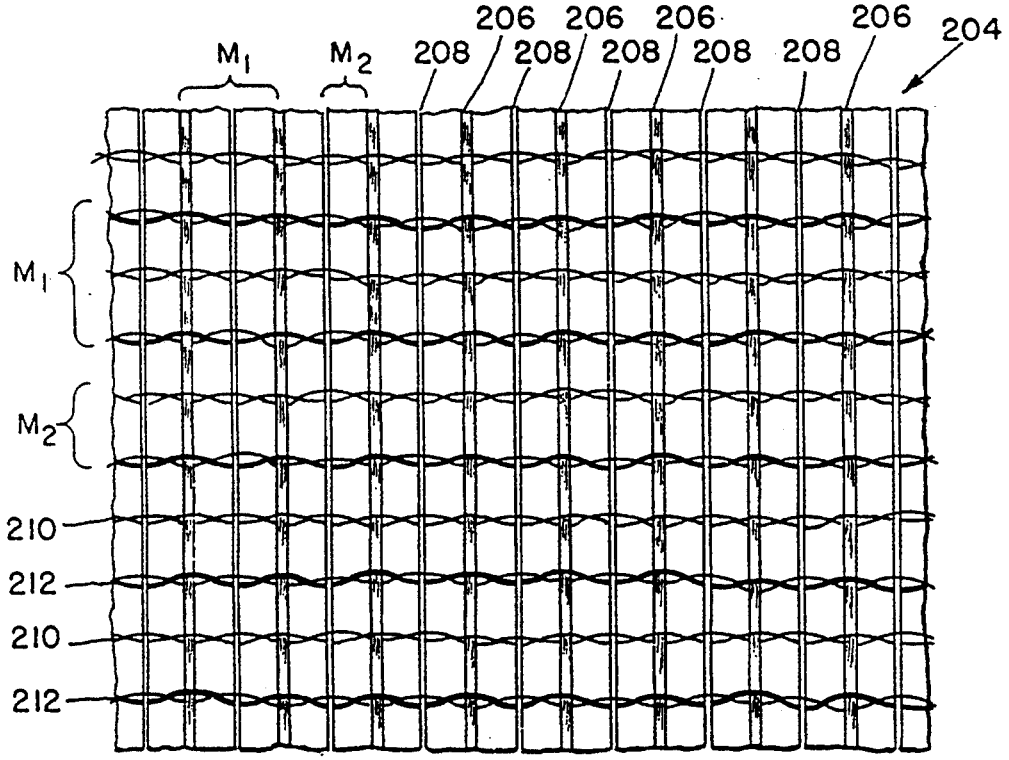
FIG. 2 is a sketch of a hybrid woven mesh according to an embodiment of the invention.

FIG. 2 shows the construction of a hybrid mesh 204. Here, a lino weave is used. Fill yarns 206 are carbon yarn. Carbon fill yarns 206 alternate with glass fill yarns 208. The warp yarns are made by alternating glass yarns 210 and a combined glass and carbon yarn 212.

The end result is an open fabric with a major cell having a dimension $M_1$ which is bounded by high temperature fiber. The major cell is filled with minor cells having a dimension $M_2$ which is defined by low temperature fiber. Preferably, a dimension $M_1$ is below four inches, more preferably $M_1$ will be below one inch and most preferably approximately one half inch. The dimension $M_2$ is preferably less than two inches and more preferably below one half inch. Most preferably $M_2$ is approximately one quarter inch. Mesh with these spacings provides adequate strength and reduces fissuring when used in intumescent materials. The spacing is large enough, though to allow easy incorporation into a mastic coating.

In FIG. 2, hybrid mesh 204 is shown with major and minor cells both being square. It is not, however, necessary that the cells be square. The cells could be rectangular or of any shape resulting from the construction of the mesh.

Figure 3:
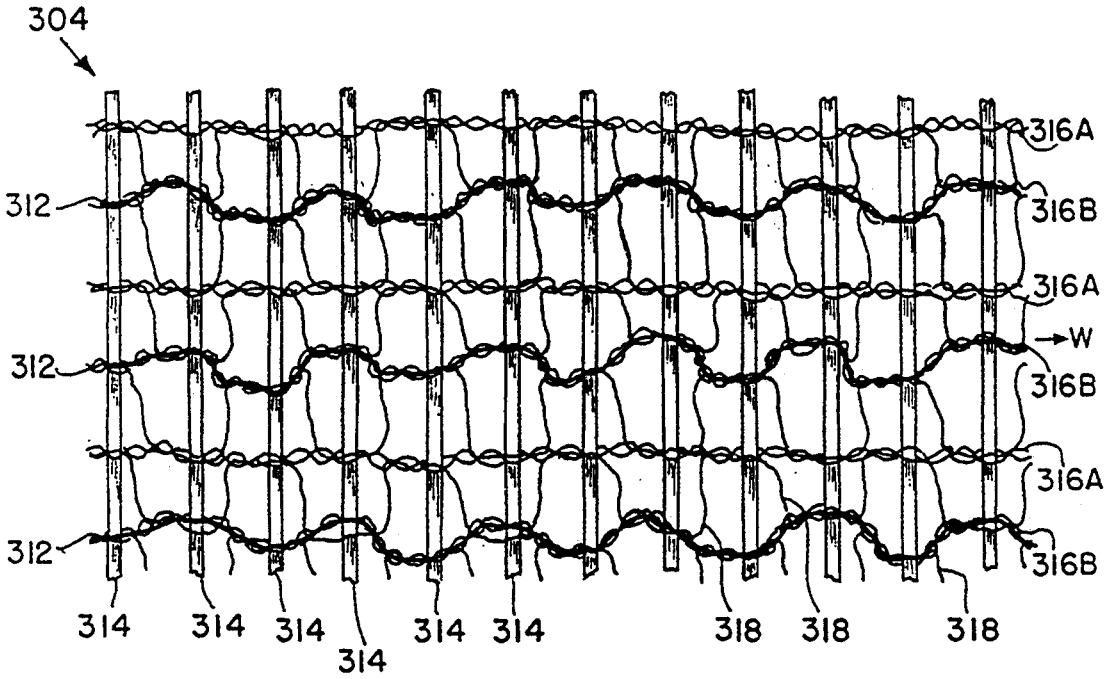
FIG. 3 is a sketch of a hybrid knitted mesh according to an embodiment of the invention.

For example, in FIG. 3, a hybrid mesh 304 is shown with high temperature warp fibers 312 which are not straight. As a result, the major and minor cells are not rectangular.

The hybrid mesh 304 of FIG. 3 is a knitted mesh which provides the advantages of easily expanding in the warp direction, W. Expansion of the mesh is desirable when used an reinforcement of intumescent fire protecting coatings. As the coating intumesces, it pushes outwards as it expands to provide a thick blanket of insulation. If the mesh expands, it will allow the coating to intumesce more and therefore provide greater insulation.

This added expansion is particularly important at edges or on small diameter objects, such as pipes, where the expanded coating has a greater surface area than the unexpanded coating. Fissures are most likely to occur in the intumescent coating at these places. To achieve full benefit from an expandable mesh, though, it is necessary that hybrid mesh 304 be oriented with warp direction, W, perpendicular or tangential to the direction of expansion. In FIG. 1, for example, the warp direction W is shown to be around the flange edges of column 100. In this way, as the radius of the coating around the flange edges increases in a fire, the mesh reinforcement will increase also. As a result, less fissuring of the intumescent coating on the flange edges is likely.

A second advantage of an expandable mesh is that less intumescent fire protective material is needed. We have observed that with the use of mesh, when fissures do occur, they are not as deep. In general, the fissure does not penetrate into the coating any deeper than the mesh. With expandable mesh, the mesh moves further from the substrate as the material intumesces. As a result, a thicker insulating material is between the mesh and the substrate. Thus, when fissures form, down to the mesh, the substrate is better insulated. This effect is particularly important for thin coatings, say less that 0.35".

Returning now to FIG. 3, the construction of the hybrid mesh is described in greater detail. Hybrid 304 is a fabric characterized as a 2-bar marquisette with warp layin and weft insertion. Amoco T-300 3,000 filament carbon yarn was used as the high temperature fiber. Owens-Corning ECC150 glass yarn was used as the low temperature fiber. Warp carbon fibers 312 and weft carbon fibers 314 define major cells which have corners spaced apart ½" in each direction. Minor cells are defined by warp glass yarn 316 and weft glass yarns 318. The glass yarns make squares which are approximately ½". Since these squares are offset by ¼" from the squares formed by the carbon yarns, they are bisected along the long axes by the weft carbon yarns 314 to form two ¼" minor cells.

Hybrid mesh 304 was made on a Raschel knitting machine equipped with weft insertion. Stitches running in the warp direction W are made by knitting two glass yarns in a pillar stitch, four pillar stitches per inch. These stitches are spaced apart ¼". Every other pillar stitch 316B encompasses a single carbon yarn 312.

The weft carbon fibers 314 are added by weft insertion. The weft glass fibers 318 are produced by "laying in" every ½". Laying in means that a yarn from one pillar is transferred to the adjacent stitch.

Warp yarns 316B are not straight. The serpentine shape of these fibers results from the fact that, due to the inclusion of carbon yarn 312 in stitches 316B, the tension is different in yarns 316A and 316B. This serpentine shape is desirable because it allows the mesh to stretch.

Sizing may be used on the hybrid mesh to improve the handleability of the mesh.

Returning to FIG. 1, column 100 is coated according to the following procedure. First, a layer of mastic intumescent coating is applied to column 100. The mastic intumescent may be applied by spraying, troweling or other convenient method. Before the coating cures, the hybrid mesh 104 is rolled out over the surface. It is desirable that mesh 104 be wrapped as one continuous sheet around as many edges of column 100 as possible. Mesh 104 is pressed into the coating with a trowel or roller dipped in a solvent or by some other convenient means.

Thereafter, more mastic intumescent material is applied. Coating 102 is then finished as a conventional coating. The carbon mesh is thus "free floating" because it is not directly mechanically attached to the substrate.

EXAMPLE I

A steel pipe of roughly 18" circumference was coated with 8 mm of intumescent fire proofing material. A hybrid mesh as shown in FIG. 3 was embedded in the coating approximately 5 mm from the surface of the pipe. The pipe was placed in a 2,000° F. furnace.

After testing, the glass portions of the hybrid mesh were not observable. The carbon portions of the hybrid mesh were found approximately 9–10 mm from the surface of the pipe. The circumference of the hybrid mesh had increased approximately 1¾" from approximately 18⅓". Qualitatively, the coating was observed to have less severe fissures than similar substrates protected with intumescent fireproofing material reinforced with metal mesh.

EXAMPLE II

A hybrid mesh as shown in FIG. 3 was embedded in a mastic intumescent fire protective coating applied to a section of a 10WF49 beam. The coating was applied at an average thickness of 5 mm. The hybrid mesh was embedded 3 mm from the surface at the flange edges of the beam. When placed in a furnace which was already heated to 2,000° F., the average temperature of the beam, as measured by thermocouples embedded in the beam, was 1,000° F. after 48 minutes. For a second beam segment coated with 7 mm of fire protective material with the same type mesh, the time to 1,000° F. was 63 minutes.

For comparison, a similarly tested beam without mesh reached 1,000° F. after 30 minutes.

While not directly comparable, a 10WF49 column was coated with 0.27 inches of intumescent fire protective material. Metal mesh was embedded in the coating at the flange edges. The column was placed in a furnace which was then heated to 2,000° F. according to the UL 1709 protocol. The column reached an average temperature of 1,000° F. after 60 minutes. If scaled to a thickness of 5 mm, this time is equivalent to only 44 minutes.

Figure 4:
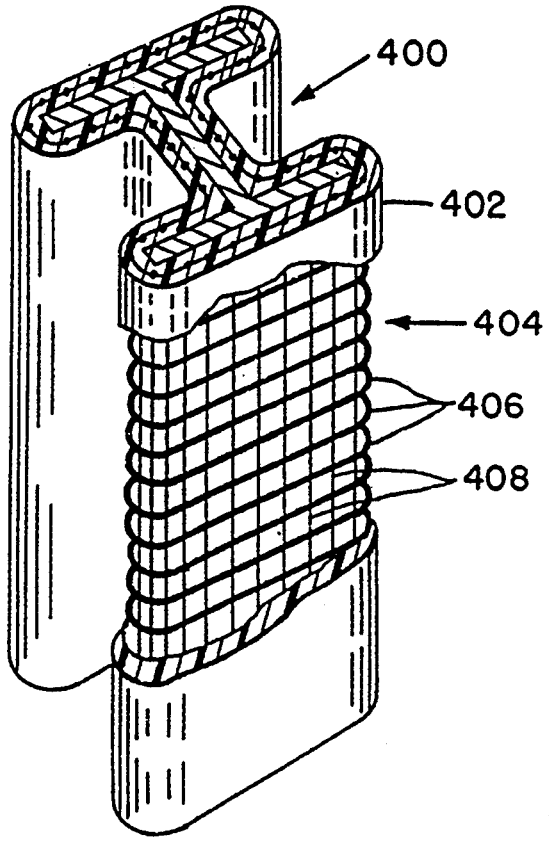
FIG. 4 is a sketch of a coated beam with a hybrid mesh according to an embodiment of the invention.

Turning now to FIG. 4, an alternative hybrid 404 mesh is shown embedded in a fire protective coating 402. As shown, mesh 404 has carbon yarns 406 running in only one direction around flange edges of a column. Carbon yarns 406 are held together by low temperature fibers 408. In this way, the amount of high temperature fibers is reduced.

Having described the invention, it will be apparent that other embodiments might be constructed. Different types or combinations of fibers might be used. The hybrid mesh as described herein might also be used to reinforce fire protective coatings on a variety of substrates, such as beams, columns, bulkheads, decks, pipes, tanks and ceilings. The invention should, thus, be limited only by the spirit and scope of the appended claims.

What is claimed is:

1. A mesh fabric comprising:

a) a first plurality of fibers retaining in excess of 80% of their room temperature tensile strength at 343° C. running in the warp and weft directions defining major cells bounded by the first plurality of fibers and having major dimensions, with corners spaced apart in each direction by less than four inches; and b) a second plurality of fibers which retain less than 80% of their room temperature tensile strength at 343° C. intermeshed with the first plurality of fibers to define minor cells having minor dimensions, with corners spaced apart in each direction by less than two inches, each said major cell being filled with said minor cells, to provide a mesh fabric having appropriate handleability properties and sufficient tensile strength at 343° C. for use as a reinforcement system for mastic fire protection coatings.

2. The fabric of claim 1 where the first plurality of fibers comprises carbon fibers.

3. The fabric of claim 2 wherein the second plurality of fibers comprises glass fibers.

4. The fabric of claim 1 wherein the major cells have corners spaced apart by more that ¼".

5. The fabric of claim 1 wherein the first plurality of fibers comprises ceramic fibers.

6. The fabric of claim 1 wherein a portion of the first plurality of fibers has a serpentine pattern in the warp direction, which allows the mesh to be stretched in said warp direction.

7. The fabric of claim 6 wherein a portion of the second plurality of fibers is knitted.

8. In a substrate coated with a fire protective material, a mesh embedded in the fire protective material comprising:

a) a first plurality of fibers retaining in excess of 80% of their room temperature tensile strength at 343° C. running in the warp and weft directions defining major cells bounded by the first plurality of fibers and having major dimensions, with corners spaced apart in each direction by less than four inches; and b) a second plurality of fibers which retain less than 80% of their room temperature tensile strength at 343° C. intermeshed with the first plurality of fibers to define minor cells having minor dimensions, with corners spaced apart in each direction by less than two inches, each said major cell being filled with said minor cells, to provide a mesh fabric having appropriate handleability properties and sufficient tensile strength at 343° C. for use as a reinforcement system for mastic fire protection coatings.

9. The substrate of claim 8 wherein the fire protective coating is selected from the group containing intumescent coatings, subliming coatings and ablative coatings.

10. The substrate of claim 8 additionally comprising an edge coated with fire protecting material and wherein the mesh stretches in a first direction and the mesh is disposed with the first direction perpendicular to the edge.

11. The substrate of claim 10 wherein a portion of the first plurality of fibers has a serpentine pattern in the warp direction, which allows the mesh to be stretched in said warp direction.

12. The substrate of claim 11 wherein the first plurality of fibers comprises carbon fibers.

13. The substrate of claim 12 wherein the second plurality of fibers comprises glass fiber.

14. The substrate of claim 8 wherein the first plurality of fibers comprises carbon fibers.

15. The substrate of claim 14 wherein the second plurality of fibers comprises glass fibers.

* * * * *